US006478441B2

(12) United States Patent
Lam

(10) Patent No.: US 6,478,441 B2
(45) **Date of Patent: *Nov. 12, 2002**

(54) HAND HELD LIGHT APPARATUS

(75) Inventor: Man Kuen Lam, North Point (HK)

(73) Assignee: Sky City International Limited, Hong Kong (HK)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/276,142

(22) Filed: Mar. 25, 1999

(65) Prior Publication Data

US 2002/0071270 A1 Jun. 13, 2002

(51) Int. Cl.[7] ..... F21V 33/00

(52) U.S. Cl. ..... 362/109; 362/205; 362/221; 362/265; 315/213; 315/216; 340/321

(58) Field of Search ..... 362/102, 109, 362/221, 263, 205, 265, 183, 186; 340/321, 331; 315/57, 58, 61, 208, 212, 213, 219, 216, 244, 245

(56) References Cited

U.S. PATENT DOCUMENTS

| | | | | | |
|---|---|---|---|---|---|
| 3,953,768 | A | * | 4/1976 | Meredith et al. | 317/31 |
| 4,314,316 | A | * | 2/1982 | Gertler et al. | 362/86 |
| 5,155,668 | A | * | 10/1992 | Tanner et al. | 136/291 |
| 5,400,008 | A | * | 3/1995 | Toohey | 340/321 |
| 5,436,814 | A | * | 7/1995 | Hanley | 362/216 |
| 6,034,485 | A | * | 3/2000 | Parra | 315/209 |

* cited by examiner

*Primary Examiner*—Sandra O'Shea
*Assistant Examiner*—John Anthony Ward
(74) *Attorney, Agent, or Firm*—Smith, Gambrell & Russell, LLP

(57) ABSTRACT

A hand held light apparatus is disclosed. The apparatus has a handle portion, a central portion, and a cap portion for mounting a lamp. An electric circuit, preferably located in the central portion, connects the lamp with a power source, preferably batteries in the handle portion, to activate the lamp in different selectable modes. The modes include at least a continuous on mode and an intermittent flashing mode. The apparatus is arranged to allow a member in an audience to show his or her appreciation of a performance by raising the apparatus and activating it in one or its operational modes. With its different operational modes, the apparatus also functions as an emergency signal indicator, and further can be made to serve in the way of a conventional flashlight.

9 Claims, 4 Drawing Sheets

HAND HELD LIGHT APPARATUS

BACKGROUND OF THE INVENTION

The present invention pertains to a portable, battery-operated and hand held light apparatus.

After live concerts or performances, it often has been customary for the audience to signal its appreciation, and to ask for an encore, by displaying lights visible from the stage. This has been done by members in the audience using matches or cigarette lighters, and holding the burning matches or lighters above their heads. More recently, audiences have used devices relying upon chemical reactions to generate light. There are distinct disadvantages in using matches or lighters to so indicate one's satisfaction with the performance, such disadvantages stemming from the possibility of being burned or burning others with the open flame. The relatively recent use of chemical lighting means also has disadvantages. Typically, light generated by such devices has a duration of only a few hours. Further, such devices are not reusable. Also, there are possibilities of harm to the environment and to human health from the chemicals present in such devices.

SUMMARY OF THE INVENTION

The present invention relates to a light apparatus that overcomes the disadvantages present in the prior art. The light apparatus according to the present invention relies upon electric power. In a preferred embodiment, such is provided by batteries, and the apparatus is operated to energize a lamp by way of a finger switch. Preferably, the apparatus is configured to rest comfortably within an user's hand so that the user can turn on the lamp to signal the user's appreciation during or after a performance.

The light apparatus has a flashing mode in addition to a continuous lighting mode. The flashing mode and the continuous lighting mode are chosen by the finger switch. The apparatus can be made to serve in the way of a conventional flashlight, which also provides the device with a safety function in that the device can be used to signal others that the user has an emergency.

To provide additional brightness, a noble gas electric lamp such as a neon lamp is provided. Along with this lamp, the apparatus includes an electric circuit suitable for operation of such a lamp. The circuit includes a transformer section for operating the lamp, and a portion for controlling flashing operation as well as continuous on operation.

In overview, a hand held light apparatus in accordance with the present invention comprises: a body having a handle portion, a central portion, and a cap portion; a lamp mounted within the cap portion; power supply means for providing electrical energy to the lamp; and electric circuit means for connecting the power supply to the lamp for energizing the lamp, the circuit means including an intermittent circuit for intermittently electrifying the lamp to operate the lamp in a flashing mode.

A lamp activation circuit includes an LC oscillation conversion circuit which generates high voltage to actuate the lamp in an continuous lighting mode. The circuit also includes a RC harmonic oscillation circuit for controlling LC oscillation to provide the lamp with intermittent oscillation current for operating the lamp in the flashing mode. A switch provides for selection between either of the flashing or continuous lighting modes and an OFF state.

The preferred lamp is a neon lamp. The power supply for the apparatus can be batteries housed in the handle portion.

Further, the cap portion could be detachable to be interchangeable with like cap portions of different colors and/or shapes.

BRIEF DESCRIPTION OF THE DRAWINGS

Further aspects and features of the invention will be even more apparent from the following detailed description and drawings, and the appended claims. In the drawings:

DETAILED DESCRIPTION OF THE PREFERRED EMBODIMENT

Figure 1:
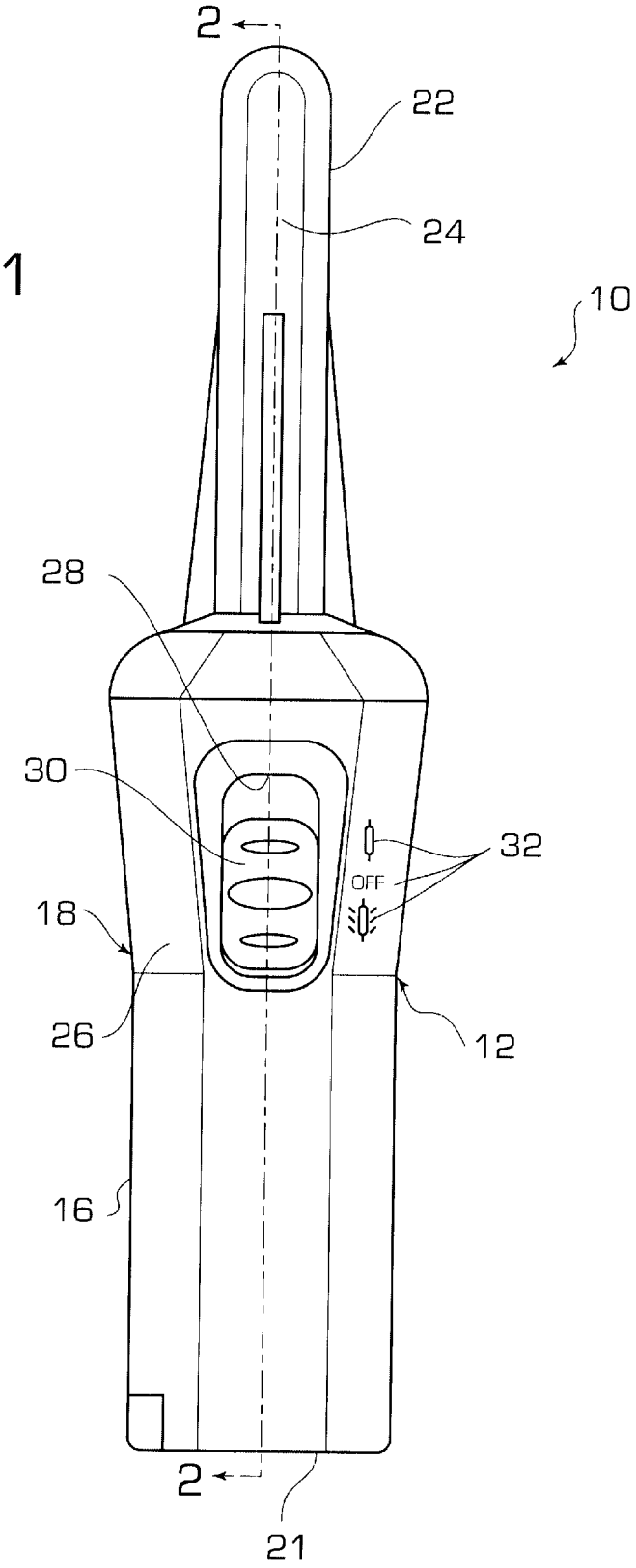
FIG. 1 is a front, perspective view showing a preferred hand held light apparatus in accordance with the present invention.
Figure 2:
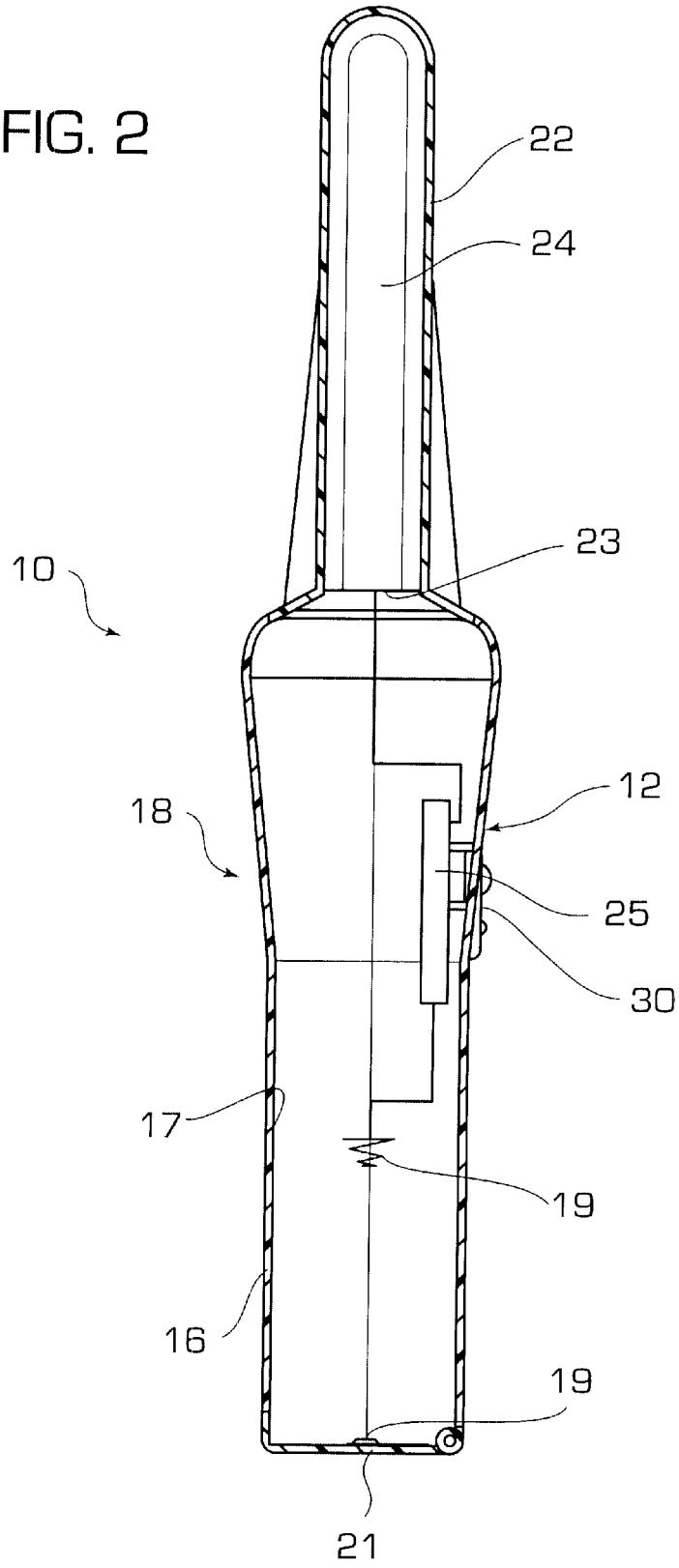
FIG. 2 is a partially schematic, sectional view along line 2—2 of FIG. 1.

FIGS. 1 and 2 are perspective and sectional views of a light apparatus 10 in accordance with the present invention. From FIGS. 1 and 2, apparatus 10 is seen to include a body portion 12 and a cap portion 22 attached to the top of the body portion. Body portion 12 includes a handle portion 16 and a central, relatively-wider portion 18. In the preferred embodiment, handle portion 16 and central portion 18 integrally are connected.

Handle portion 16 is configured to contain batteries (not shown in FIGS. 1 and 2) as the supply of electrical power. With particular reference to FIG. 2, handle portion 16 has a battery compartment 17 with contacts 19 at either end for connecting the batteries to an electric circuit 25 on a printed circuit board (PCB) and ultimately a lamp 24 for operating the apparatus 10. Contacts 19 can be of any conventional arrangement appreciated by those of ordinary skill in the art. A hinged lower cap 21 or the like is provided at the bottom of the handle portion for battery replacement. As is apparent, handle portion 16 can be modified accordingly where other electric sources, such stored solar power, are used to power apparatus 10.

Inside the cap portion 22 there is a lamp 24 which mounts to central portion 18. Cover 22 is transparent, or at least translucent. Two wires 23 in central portion 18 connect lamp 24 with the electric circuit. In preferred apparatus 10, lamp 24 is a neon tube. Light from lamp 24 is transmitted through cover 22. Cover 22 could be detachable from central portion 18 by hand so that different covers could be substituted for the cover on the apparatus 10 at any given time. It is contemplated that apparatus 10 be provided with plural covers 22 of different colors and/or shapes so that the user can decide which the user prefers.

Central portion 18 houses the circuit elements 25 connecting batteries in handle portion 16 with lamp 24. Centered in a front face 26 of upper portion 18 is an area 28 that provides for three positions of a three-way switch 30. In preferred apparatus 10, switch 30 is moveable among three positions by finger pressure. In the embodiment shown, markings 32 on front face 26 include a central, OFF position between an upper position in which lamp 24 is placed in a continuous lighting mode, and a lower position in which the lamp 24 is placed in a flashing mode. As now apparent, these and other parts of apparatus 10 could be fabricated from a phosphorescent material, according to user needs, so that they would be visible to the user in a darkened setting. Also, of course, other switch arrangements that provide different settings corresponding to different modes would be suitable as apparent to those of ordinary skill in the art.

Figure 3:
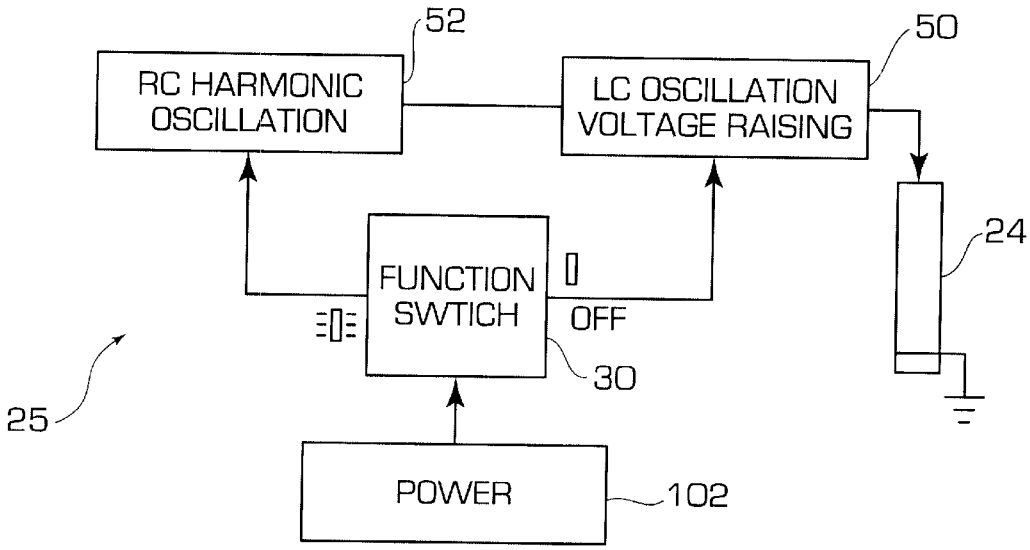
FIG. 3 is a block diagram of the-lamp control circuit of the apparatus of FIG. 1.

FIG. 3 is a block diagram corresponding to circuit 25. Switch 30 is shown as connected to receive power from batteries 102 or the like. Switch 30 controls a LC oscillation circuit 50 for providing the continuous lighting mode. Oscillation circuit 50 is a conversion circuit that generates a sufficiently high output voltage necessary to activate neon lamp 24. For providing flashing operation of lamp 24, switch 30 also connects to RC harmonic oscillation circuit 52, the oscillatory output from which is applied to LC oscillation circuit 50 to control the output voltage from the LC circuit to vary regularly.

Figure 4:
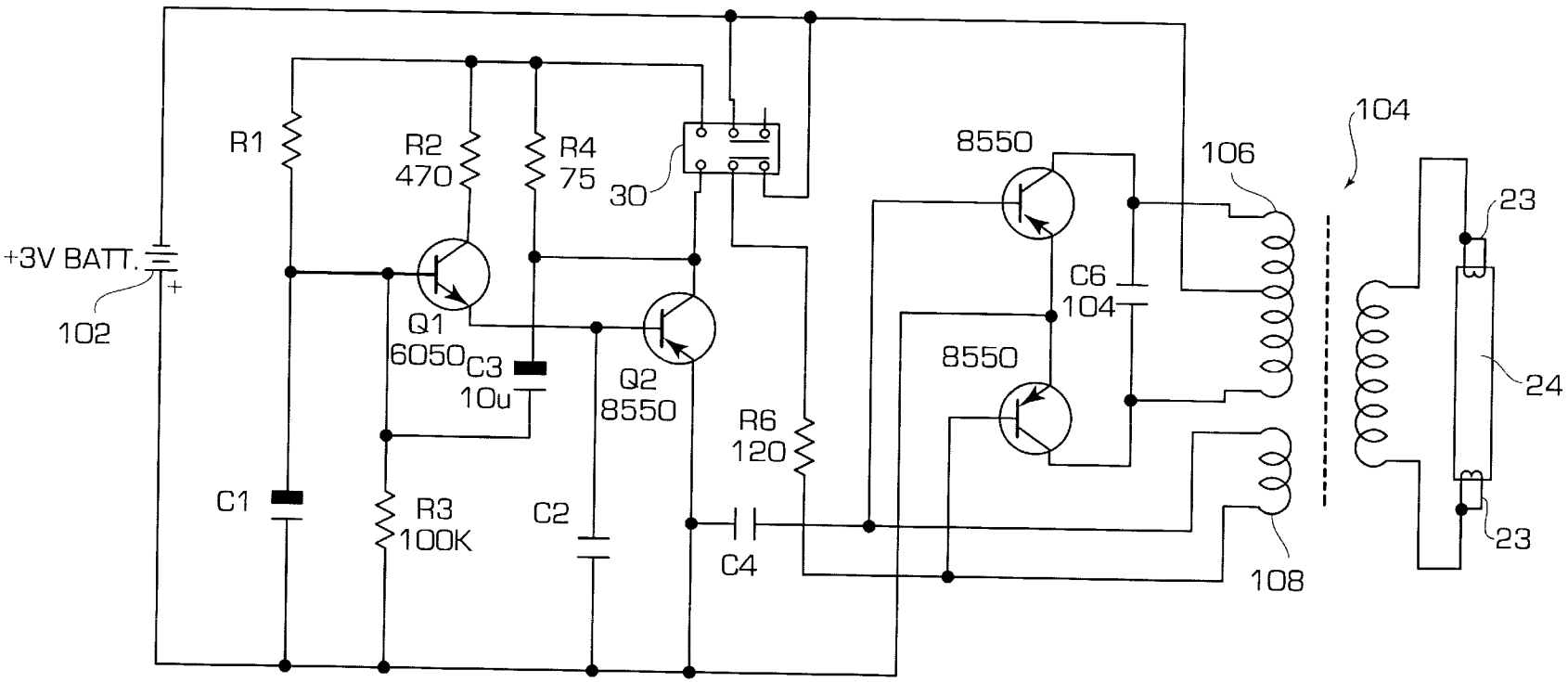
FIG. 4 is a circuit diagram of a control circuit suitable for use in the apparatus of FIG. 1.

FIG. 4 is a diagram of a preferred circuit 100 suitable for use in apparatus 10. As shown in FIG. 4, battery 102 is connected to a transformer assembly 104 and also to a transistor Q3 through winding 106. The positive terminal of battery 102 also directly is connected to switch 30 and a capacitor C3, the other side of which capacitor is connected to ground. Transformer assembly 104 includes two windings 106 and 108 on its primary winding side and a single secondary winding (wires 23) connected to lamp 24, on the secondary winding or lamp side. The base of a transistor Q1 is connected between resistors R1 and R3, and connected to the negative battery terminal through resistor R3. The emitter of transistor Q1 is connected to switch 30 through resistor R2 and the collector thereof in turn is connected to the base of transistor Q2 and to capacitor C2. The collector of transistor Q2 connects to switch 30 through diode D1 and resistor R5, and to resistor R4, while the emitter of transistor Q2 connects to the negative side of the battery. A capacitor C1 connects the base of the transistor Q1 to a point between the collector of transistor Q2 and resistor R4, on the input side of diode D1. The output side of the diode connects to switch 30 through resistor R5. The emitter of transistor Q3 also connects to the negative terminal of battery 102. The collector of transistor Q3, in turn, connects to one side of primary winding 106.

In use, apparatus 10 provides a multi-purpose light and flashing device. It is contemplated, that during concerts, the user would place apparatus 10 either in its continuous lighting or flashing modes to indicate the user's approval.

Although the present invention has been described in connection with a preferred form thereof, it is to be understood that the disclosure of the preferred form is made only by way of example and that numerous changes may be made without departing from the spirit and scope of the invention as claimed.

What is claimed is:

1. A hand held light apparatus comprising:

a body having a handle portion, a central portion, and a cap portion;

first contact means for electrically contacting a lamp mounted within said cap portion;

a solar power supply source for storing and providing electrical power;

second contact means, including two contacts carried in said body, for contacting said solar power supply for providing electrical energy to a PCB; and electric circuit means on said PCB for connecting said second contact means to said first contact means for energizing a mounted lamp, said circuit means including:

(a) an intermittent circuit for providing the lamp with intermittent high working voltage whereby the lamp operates in a flashing mode, (b) a continuous on circuit for operating a mounted lamp in a continuous lighting mode, and (c) a switch located on the central portion for selection between either of said flashing and continuous lighting modes and an OFF state, wherein each of said flashing mode, continuous mode, and OFF state have a corresponding fluorescent switch position indicated on the central portion, and wherein said intermittent circuit and said circuit for operating in a continuous on mode include an RC harmonic oscillation circuit and an LC oscillation circuit with an output of the RC oscillation circuit applied as an input to the LC oscillation circuit.

2. An apparatus as claimed in claim 1, wherein said apparatus includes a lamp and said lamp is a noble gas lamp.

3. An apparatus as claimed in claim 2, wherein said lamp is a neon lamp.

4. An apparatus as claimed in claim 2, wherein said apparatus includes batteries as a power supply therefore, and said handle portion houses said batteries.

5. An apparatus as claimed in claim 1, wherein said cap portion is interchangeable with cap portions of different colors.

6. An apparatus as claimed in claim 5, wherein said central portion houses said circuit means, and wherein said circuit means includes a three position finger switch located on a surface of said central portion.

7. A hand held light apparatus kit comprising:

1) a hand held light apparatus including:

a body having a handle portion, a central portion, and a cap portion, wherein said cap portion is detachable;

a lamp mounted within said cap portion;

a solar power supply means for storing and providing electrical energy to said lamp; and electric circuit means for connecting said power supply means to said lamp for energizing said lamp, said circuit means including:

(a) an intermittent circuit for intermittently electrifying said lamp to operate said lamp in a flashing mode, (b) a continuous on circuit for operating said lamp in a continuous on mode, and (c) a switch located on the central portion for selection between either of said flashing and continuous on modes and an OFF state, wherein each of said flashing mode, continuous mode, and OFF state have a corresponding fluorescent switch position indicated on the central portion, and wherein said intermittent circuit and said circuit for operating in a continuous on mode include an RC harmonic oscillation circuit and an LC oscillation circuit with an output of the RC oscillation circuit applied as an input to the LC oscillation circuit; and 2) a plurality of caps, wherein each of said caps is of a different color, has a different shape, is interchangeable, and covers said lamp when attached to said hand held light apparatus.

8. An apparatus as claimed in claim 7, wherein said central portion houses said circuit means, and wherein said circuit means includes a three position finger switch located on a surface of said central portion.

9. A hand held light apparatus comprising:

a body having a handle portion, a central portion, and a cap portion, a lamp mounted within said cap portion;

power supply means for providing electrical energy to said lamp; and electric circuit means for connecting said power supply means to said lamp for energizing said lamp, said circuit means including:

(a) an intermittent circuit for intermittently electrifying said lamp to operate said lamp in a flashing mode, (b) a continuous on circuit for operating said lamp in a continuous on mode, and (c) a switch located on said central portion for selection between either of said flashing and continuous on modes and an OFF state, wherein said intermittent circuit and said circuit for operating in a continuous on mode include an RC harmonic oscillation circuit and an LC oscillation circuit with an output of said RC oscillation circuit applied as an input to said LC oscillation circuit, and wherein said circuit means includes a transformer assembly connected to said power supply means and also a first transistor means through a first winding of said transformer assembly, a power supply means positive terminal directly connected to said switch and to a first capacitor with another side of said first capacitor being connected to ground, said transformer assembly including two windings with said first winding on its primary winding side, and a single secondary winding connected to said lamp on its secondary winding side, a second transistor connected between first and second resistors and being connected to a negative terminal of said power supply means through said second resistor, said second transistor being connected to said switch through a third resistor and being connected to a third transistor and to a second capacitor, said third transistor being connected to said switch through a diode and a fourth resistor, being connected again to said switch through a fifth resistor, and being connected to said negative side of said power supply means, a third capacitor connecting said second transistor to a point between said third transistor and said fifth resistor on an input side of said diode, an output side of said diode being connected to said switch through said fourth resistor, said first transistor also being connected to said negative terminal of said power supply means, and said first transistor also being connected to one side of said first primary winding.

* * * * *